US005606407A

United States Patent [19]

Suzuki

[11] Patent Number: 5,606,407

[45] Date of Patent: Feb. 25, 1997

[54] IMAGE FORMING APPARATUS WITH JAM CLEARING MECHANISM

[75] Inventor: Tomohisa Suzuki, Ebina, Japan

[73] Assignee: Fuji Xerox Co., Ltd., Tokyo, Japan

[21] Appl. No.: 573,536

[22] Filed: Dec. 15, 1995

[30] Foreign Application Priority Data

Dec. 19, 1994 [JP] Japan ..... 6-334442

[51] Int. Cl.[6] ..... G03G 15/14

[52] U.S. Cl. ..... 399/303; 271/307; 399/398

[58] Field of Search ..... 355/315, 271, 355/308, 200; 271/306, 307, 310, 312, 313

[56] References Cited

U.S. PATENT DOCUMENTS 5,537,193 7/1996 Hasegawa et al. ..... 355/271

FOREIGN PATENT DOCUMENTS 1-170973 7/1989 Japan .
2-156270 6/1990 Japan .

*Primary Examiner*—Joan H. Pendegrass
*Assistant Examiner*—Quana Grainger
*Attorney, Agent, or Firm*—Oliff & Berridge

[57] ABSTRACT

A paper folding member and a jam sensor are disposed downstream of the position at which a transfer drum confronts an image carrying body and in proximity to the transfer drum. The paper folding member is a platelike member substantially assuming a right-angled triangle, and has an edge that projects more to the upstream side at a position closer to the transfer drum pulling side. When a paper jam occurs, engagement between gears for transmitting a driving force from the image carrying body to the transfer drum is released, so that the transfer drum becomes freely rotatable in its normal rotational direction. When the transfer drum is pulled, a recording sheet is gradually taken out of a cleaning device first from its portion on the side opposite to the transfer drum pulling side, and is inserted between the paper folding member and the transfer drum as the transfer drum is rotated. As a result, the recording sheet can be taken out of the apparatus without getting separated from the transfer drum.

4 Claims, 10 Drawing Sheets

IMAGE FORMING APPARATUS WITH JAM CLEARING MECHANISM

BACKGROUND OF THE INVENTION

1. Field of the Invention

The invention relates to image forming apparatuses such as a copying machine and a printer which utilizes electrophotography. The invention is directed, in particular, to an image forming apparatus that transfers a toner image formed on an image carrying body onto a recording sheet held on a transfer drum.

2. Description of the Related Art

In image forming apparatuses such as a copying machine and a printer, a laser beam is irradiated onto a photoreceptor, which is an image carrying body, to thereby form a latent electrostatic image, and the thus-formed latent electrostatic image is visualized by depositing toner on the latent electrostatic image to thereby form a toner image. Then, the thus-formed toner image is transferred onto a sheet to thereby produce a printed image. Among these image forming processes is a process in which the toner image formed on the photoreceptor is transferred onto a sheet by a transfer device. One such process involves the steps of: forwarding a sheet to a position confronting the photoreceptor by, e.g., causing the sheet to be electrostatically adsorbed to the transfer drum; and applying a voltage whose polarity is opposite to the polarity of the toner to the sheet from the back side of the sheet, so that the toner image formed on the photoreceptor is be transferred onto the sheet.

In transferring a toner image by adsorbing a sheet to the transfer drum this way, sheet adsorbing performance of the transfer drum may depend on how the sheet is electrically charged. That is, if the force through which the sheet is adsorbed to the transfer drum is weak, the sheet will get separated from the transfer drum and will therefore adhere to the photoreceptor, and this may cause a paper jam (POP jam, or "paper on the photoreceptor jam"). If the paper jam is sensed belatedly in this case, the sheet is continuously forwarded as the photoreceptor rotates, so that its head portion is threaded into a portion confronting the cleaning device by the time the operation of the apparatus is stopped. If the transfer drum is pulled in the axial direction in order to remove the jammed sheet, the head portion of the sheet gets torn as the sheet is taken out of the cleaning device, thus leaving a torn piece of paper inside the image forming apparatus. If the torn piece of paper is left inside the apparatus, it causes such inconvenience as damaging the photoreceptor and the cleaning device upon reactivating the apparatus next time. Hence, a jammed sheet should be removed from the apparatus without leaving a torn piece of paper therein.

To avoid such inconvenience, an apparatus has been proposed in which a jam sensor is disposed downstream of a position where the photoreceptor confronts the transfer drum so as to confront the photoreceptor. With this configuration, a sheet adhering to the photoreceptor is sensed to thereby stop a driving system of the apparatus. In this apparatus, a sheet adhering the photoreceptor is directly sensed with the jam sensor, and the operation of the apparatus is stopped before the head portion of the sheet is threaded into the cleaning device. An optical sensor including a light emitting element such as a LED (light emitting diode) and a photodetecting element such as a PD (photodiode) is frequently used as the jam sensor in view of its advantages of being inexpensive and not being in contact with the photoreceptor.

Further, an image forming apparatus disclosed in Japanese Unexamined Patent Publication No. Hei. 2-156270 employs a device that judges arrival of a sheet through a comparison with a photodetection value of a photoreceptor surface portion by appropriately adjusting either the amount of light emitted by the light emitting element or the photodetection sensitivity of the photodetecting element, when a paper jam occurs.

Such an image forming apparatus, being capable of sensing a paper jam quickly, can prevent a sheet from entering into the portion confronting the cleaning device. Hence, such an image forming apparatus also provides the advantage that a sheet is not torn when the transfer drum is pulled out.

However, the aforementioned image forming apparatus has the following problems.

Where a paper jam is sensed by the aforementioned optical sensor, it is difficult to distinguish untransferred toner on the photoreceptor from a sheet adhering to the photoreceptor. That is, since a sheet is distinguished based on a difference in the intensity of reflected light, it is particularly difficult to distinguish a sheet from untransferred toner on the photoreceptor which has a high reflectance, such as yellow toner used in a full-color image forming apparatus. Further, where a paper jam occurs during formation of an image on the back side of a sheet in a double-sided image forming operation, it is also difficult to distinguish untransferred toner on the photoreceptor from a previously formed image, disabling correct detection of such a paper jam.

When a paper jam is not sensed correctly, the apparatus cannot be stopped quickly, which brings about a problem that the threading of a sheet into the portion confronting the cleaning device with the sheet adhering to the photoreceptor cannot be prevented reliably even if the optical sensor is employed.

SUMMARY OF THE INVENTION

The invention has been made in view of the aforementioned problems. The object of the invention is, therefore, to provide an image forming apparatus capable of easily eliminating a sheet without tearing it at the time of pulling out a transfer drum even where the sheet adheres to a photoreceptor and is threaded into the portion confronting a cleaning device.

According to the invention, there is provided an image forming apparatus comprising:

- an image carrying body having a circumferential surface on which a latent electrostatic image is to be formed;
- a developing device for forming a toner image by depositing toner on the latent electrostatic image;
- a transfer drum rotatably supported in proximity to or in contact with the image carrying body, the transfer drum being a cylindrical member capable of holding, on a circumferential surface thereof, a recording sheet on which the toner image is to be transferred, the transfer drum being supported so that it can be pulled out along an axis thereof when the recording sheet is jammed;
- drive means for rotationally driving the transfer drum at the time of transferring the toner image;
- a cleaning member being in contact with the image carrying body, for eliminating toner remaining on the image carrying body after completion of a transfer operation;

a platelike paper folding member disposed downstream of a position at which the transfer drum confronts the image carrying body, and having a surface that confronts the circumferential surface of the transfer drum substantially in parallel with the axis of the transfer drum, and an edge that projects more to an upstream side at a position of the edge closer to a transfer drum pulling side; and driving force transmission release means for releasing transmission of a driving force from the drive means to the transfer drum, and for rendering the transfer drum freely rotatable at least in a normal rotational direction thereof when the transfer drum is pulled out.

The paper folding member is taken outside as the transfer drum is pulled out. The paper folding member may have any appropriate shape as long as it has the above-described edge. The edge may have some small projections and recesses. However, it is preferred such projections and recesses be curved, not angled.

Where the paper folding member is formed with a notch in its edge portion projecting to the upstream side in order to install, e.g., a density sensor, it is preferred that a portion of the notch on the transfer drum pulling side is so shaped as to project more at a position of closer to the transfer drum pulling side.

Where a gear for transmitting a driving force to the image carrying body is secured to an end portion of the image carrying body on the transfer drum pulling side, and the gear having a larger outer diameter than the circumferential surface of the image carrying body, it is preferred that a sloped surface for guiding a recording sheet be formed between an inner circumferential edge of the gear and the circumferential surface of the image carrying body.

A release preventing member may be attached to a frame for supporting the transfer drum at a position on the side opposite to the transfer frame pulling side and upstream of the position at which the transfer drum confronts the image carrying body so as to project outward past the height of the peripheral surface of the transfer drum. The release preventing member is provided to prevent a jammed recording sheet adhering to the transfer drum from being left in the apparatus when the transfer drum is pulled out. The tip portion of the release preventing member may assume, for instance, a hook-like shape to positively hook a recording sheet.

The image forming apparatus of the invention has the driving force transmission release means for releasing transmission of a driving force from the drive means to the transfer drum. Therefore, a driving force transmission mechanism is released from the drive means when a paper jam occurs during a transfer operation of a toner image, the paper jam being such that a sheet is moved to the image carrying body and reaches the portion at which the image carrying body is in contact with the cleaning device. As a result, the transfer drum becomes freely rotatable in its normal rotational direction in which the transfer drum is rotated when driven. When the transfer drum is pulled in the axial direction in this state, the sheet is also pulled in the transfer drum moving direction by the adsorbing force between the sheet and the surface of the transfer drum. At the same time, since the head portion of the sheet comes in contact with the housing of the cleaning device, a force for pushing the sheet back is produced. As a result, the sheet is given a rotating force that causes the sheet to rotate with the portion at which the sheet is in contact with the housing as a pivot. When the transfer drum is further pulled, the sheet gets separated from the surface of the transfer drum first from the transfer drum pulling side. In addition, since the transfer drum can be rotated by only a small force, the adsorbing force between the sheet and the transfer drum allows the transfer drum to rotate. As a result, on the side opposite to the transfer drum pulling side (hereinafter referred to simply as "the opposite side" where applicable), a portion of the sheet between the head portion that is threaded into the portion of the image carrying body which comes in contact with the cleaning device and the portion adsorbed to the transfer drum is curved, and then the sheet is forwarded in the transfer drum rotating direction while being adsorbed to the transfer drum.

Further, the apparatus has the paper folding member downstream of the position at which the transfer drum confronts the image carrying body, the paper folding member having the edge that projects more to the upstream side at a position closer to the transfer drum pulling side. Therefore, the curved portion of the sheet comes into contact with the edge of the paper folding member as the transfer drum rotates in the predetermined direction. As the sheet moves downstream while being in contact with the edge of the paper folding member, the sheet gets interposed between the paper folding member and the transfer drum first from the opposite side thereof.

Even if the sheet has reached the portion at which the image carrying body is in contact with the cleaning device at the time of a paper jam, the sheet is gradually taken out of that portion first from the transfer drum pulling side by the rotating force given to the sheet at the time of pulling the transfer drum, so that the sheet is interposed between the transfer drum and the paper folding member as the transfer drum rotates. With the sheet being interposed between the transfer drum and the paper folding member this way, separation of the sheet from the transfer drum can be prevented.

Hence, when the transfer drum is completely pulled out, the sheet is taken out of the apparatus while being interposed between the transfer drum and the paper folding member. As a result, tearing of the sheet can be prevented when the transfer drum is pulled out, thus facilitating removal of the sheet out of the apparatus.

The apparatus having the paper folding member whose projected edge portion is formed with the notch allows other members such as a density sensor to be disposed at a position corresponding to the notch. In addition, since the portion of the notch on the transfer drum pulling side is smoothly sloped, it can be prevented that at the time of pulling the transfer drum a recording sheet is caught by the notch and a portion of the sheet is left in the apparatus.

If a sloped surface is formed between the inner circumferential edge of the gear and the circumferential surface of the image carrying body in the case where the gear whose outer diameter is larger than that of the circumferential surface of the image carrying body is fixed coaxially to the image carrying body and used as a gear for driving the image carrying body, then a sheet taken out together with the transfer drum at the time of pulling the transfer drum moves along the sloped surface. As a result, the sheet can be taken out of the end portion of the image carrying body without being torn while caught by the gear.

In the apparatus having the release preventing member, when a jammed sheet is separated from the transfer drum because it was not firmly interposed between the paper folding member and the transfer drum, the sheet is hooked by the release preventing member and can be taken out of the apparatus. Therefore, it can be prevented that a portion of the sheet is left in the apparatus.

DESCRIPTION OF THE PREFERRED EMBODIMENTS

Embodiments of the invention will now be described with reference to the drawings.

Figure 1A:
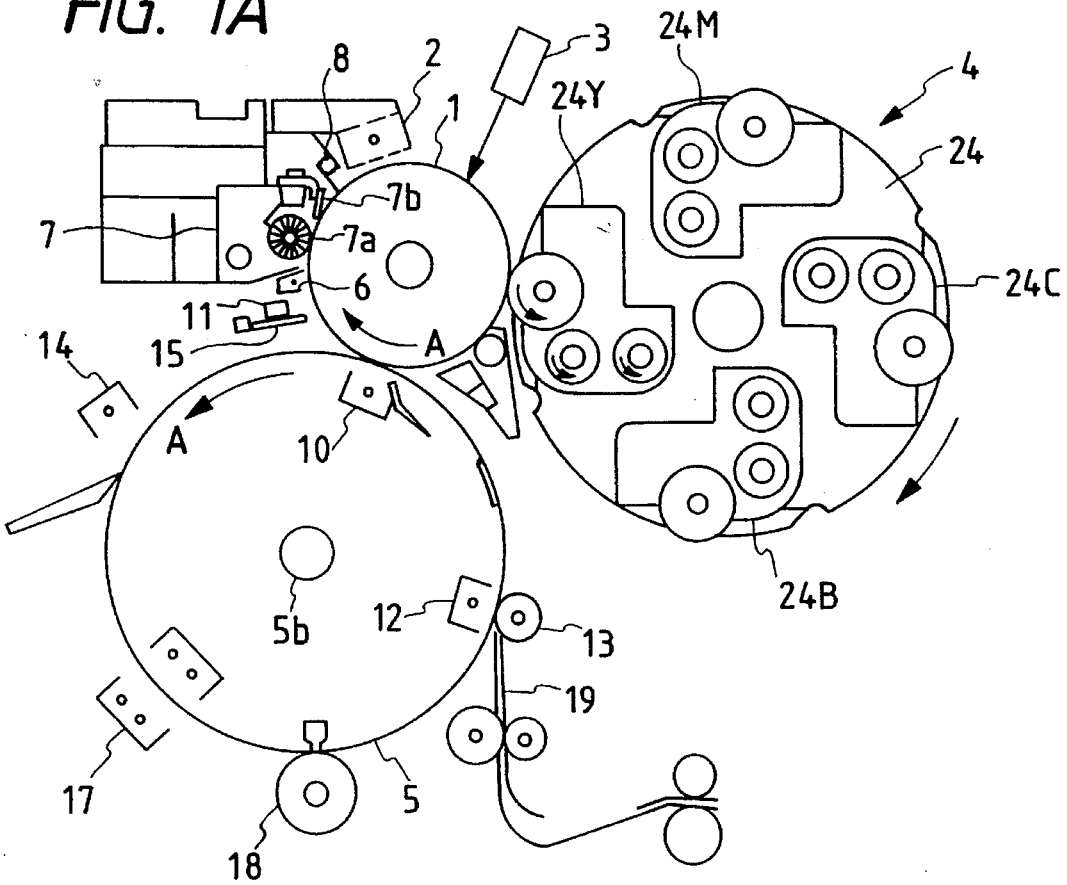
FIGS. 1A and 1B shows a general construction of an image forming apparatus according to an embodiment of the invention.
Figure 1B:
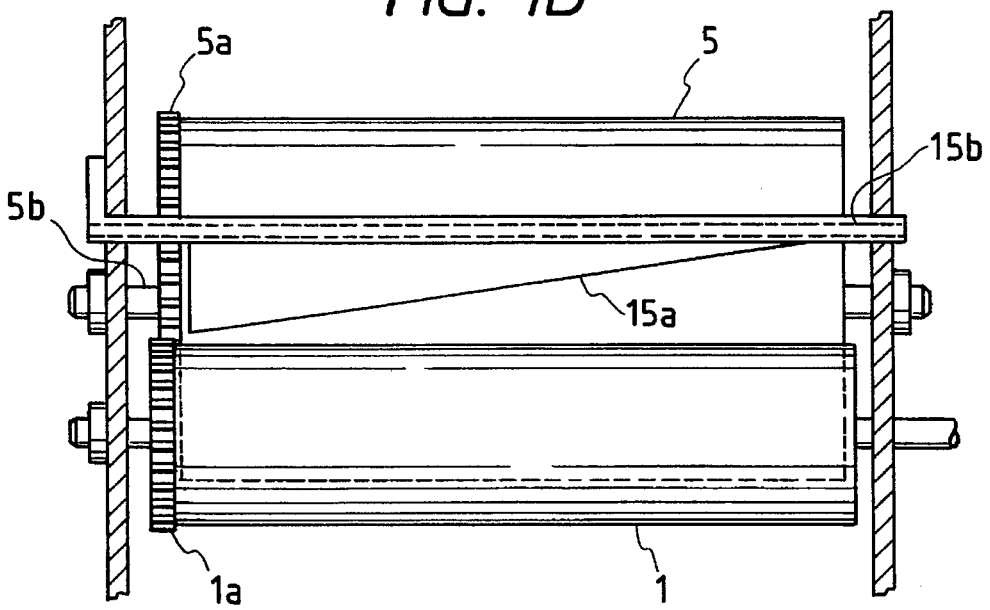

FIG. 1A is a schematic diagram showing a construction of an image forming apparatus, which is an embodiment of the invention. FIG. 1B is a plan view showing a construction of an image carrying body (photoreceptor) and a transfer drum and members in their vicinity of the image forming apparatus shown in FIG. 1A.

This image forming apparatus includes: the image carrying body 1 that allows a latent image to be formed on the surface thereof upon illumination with a laser beam after electrical uniform charging; a developing unit 4 having, in a rotating body 24 supported by a rotary shaft, four developing devices 24Y, 24M, 24C and 24B respectively containing yellow, magenta, cyan, and black toners; a charging device 2 for electrically charging uniformly the surface of the image carrying body 1 that is disposed upstream of the developing unit 4 in the image carrying body rotating direction; an exposing device 3 that applies a laser beam to the surface of the image carrying body 1 being electrically charged; a transfer drum 5, disposed downstream of the developing unit 4 so as to confront the image carrying body 1, for rotating a sheet supplied from a paper guide 19; an adsorbing corotron 12 that allows the sheet to be carried on the transfer drum 5; a paper forward roller 13 that is supported at a position confronting the adsorbing corotron 12; a transfer charger 10 that transfers a toner image from the image carrying body onto the sheet carried on the transfer drum 5; a pre-cleaning corotron 6 that electrically discharges toner remaining on the image carrying body 1 after the transfer operation has been completed; a cleaning device 7 that removes the residual toner from the image carrying body 1; and a charging eliminating device 8 that eliminates charge from the surface of the image carrying body 1 after the cleaning operation has been completed.

Downstream of the transfer discharger 10 in the transfer drum 5 rotating direction are a paper folding member 15, a post-transfer jam sensor 11, a separating device 14, a charge eliminating device 17, and a cleaner 18. The paper folding member 15 is supported substantially in parallel with the axis of the transfer drum 5 so as to be close to and confront the transfer drum 5. The post-transfer jam sensor 11 senses a paper jam in the vicinity of the paper folding member 15. The separating device 14 separates from the transfer drum 5 a sheet onto which a toner image has been transferred. The charge eliminating device 17 eliminates charge from the transfer drum 5. The cleaner 18 cleans the surface of the transfer drum 5.

Figure 4:
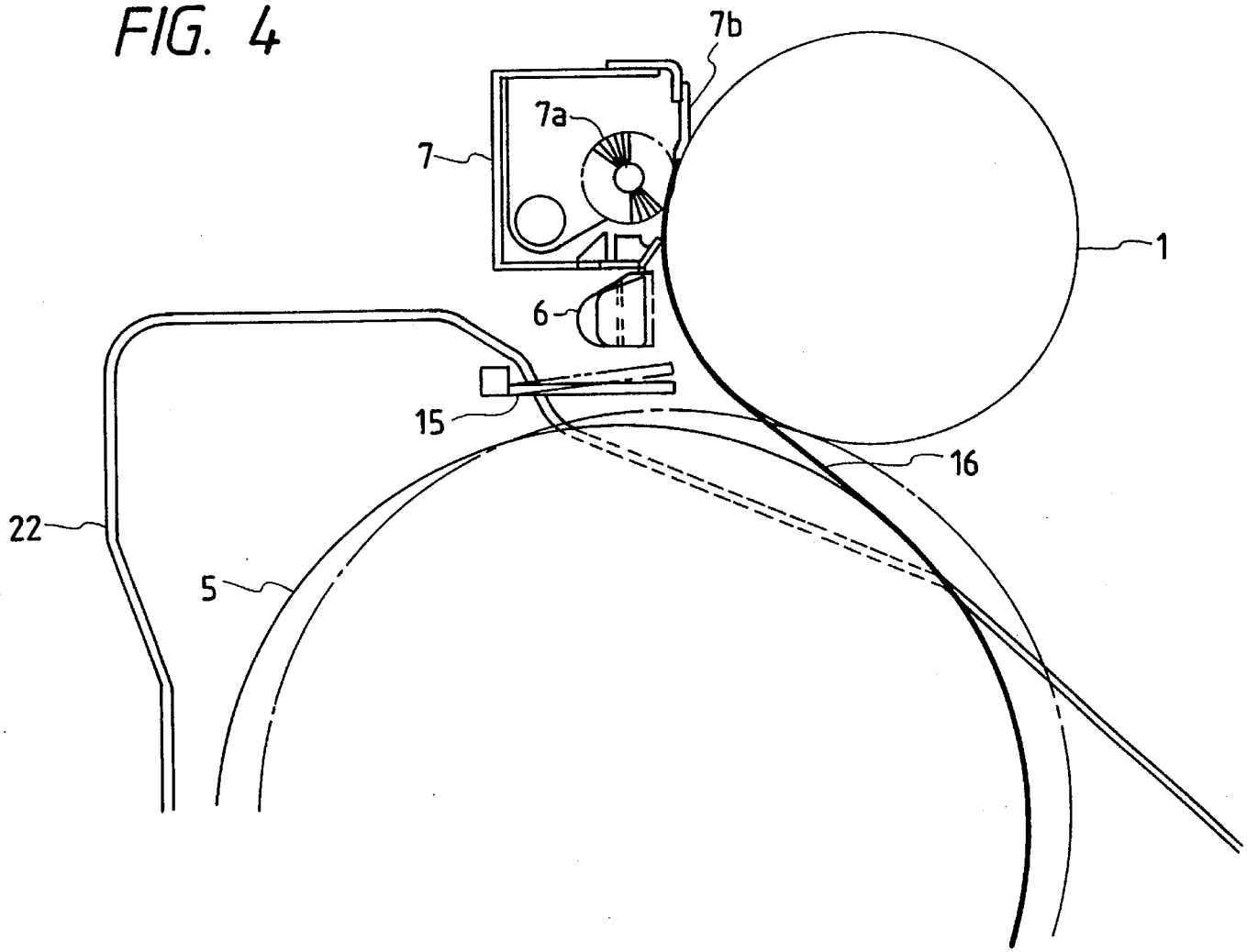
FIG. 4 shows how a POP jam is released in the image forming apparatus of FIGS. 1A and 1B.

The transfer drum 5 is formed of a cylindrical member supported by a support shaft **5*b* and has a gear 5*a* at an end. The transfer drum 5 has a circumferential surface that is rotated in a direction indicated by arrow A in FIG. 1A (hereinafter referred to as "the normal rotational direction" where applicable) when the gear 5*a* is in engagement with a gear 1*a* of the image carrying body 1 and a driving force of the image carrying body 1 is thereby transmitted to the transfer drum 5. Further, the transfer drum 5 is so arranged that the gear 5*a* is disengaged from the gear 1*a* when the transfer drum 5 is moved away from the image carrying body 1 as shown in FIG. 4. Therefore, under the condition that the transfer drum 5 has been moved away from the image carrying body 1, the transfer drum 5** is freely rotatable in the normal rotational direction by only a small force.

Figure 2:
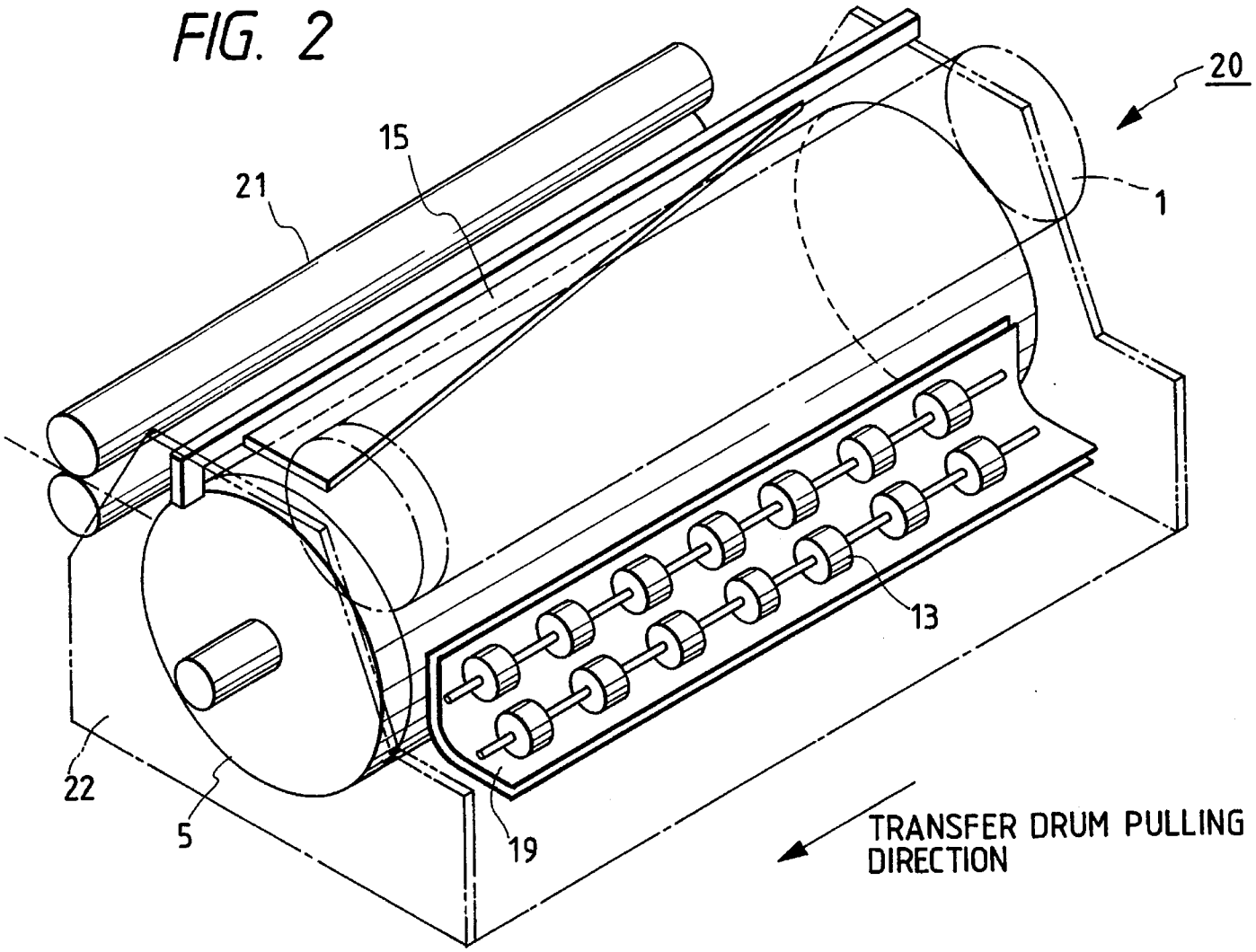
FIG. 2 is a perspective view showing a paper folding member and a transfer drum used in the image forming apparatus of FIGS. 1A and 1B.

As shown in FIG. 2, the transfer drum 5 is supported by frames 22 on both sides within a transfer drum unit 20, and the transfer drum 5 can be pulled out of the image forming apparatus main body in the axial direction. The transfer drum unit 20 has, in addition to the transfer drum 5, the paper folding member 15, the paper forward roller 13, the paper guide 19, etc.

The transfer charger 10 is firmly supported inside the transfer drum 5 at the position confronting the image carrying body 1. The transfer charger 10 electrically charges a sheet carried on the transfer drum 5 to a polarity opposite to that of the toner from the back side of the sheet. As a result of this charging operation, the toner image on the image carrying body 1 can be transferred onto the sheet that has been charged to the opposite polarity.

The adsorbing corotron 12 electrically charges the sheet forwarded from the paper guide 19 through a discharge occurring with the paper forward roller 13. As a result of the charging operation, the sheet can be electrostatically adsorbed to the circumferential surface of the transfer drum 5.

The paper folding member 15 includes a platelike member **15*a* substantially assuming a right-angled triangle and a support shaft 15*b* that supports the platelike member 15*a* on the downstream side in the transfer drum 5 rotating direction. The paper folding member 15 extends so as to cover almost the entire image carrying body 1 in its axial direction. The paper folding member 15 is so mounted that the support shaft 15*b* is firmly supported by the frames 22 of the transfer drum unit 20 and the bottom surface of the platelike member 15*a* is substantially in parallel with the axis of the transfer drum 5. Further, the right-angled portion of the platelike member 15*a* is positioned on the downstream side in the transfer drum 5 rotating direction. Also, an edge of the platelike member 15*a* projects more to the upstream side in the transfer drum 5 rotating direction at a position closer to the transfer drum 5 pulling side. The paper folding member 15 is taken out of the apparatus together with the transfer drum 5 when the transfer drum unit 20** is pulled out.

The post-transfer jam sensor 11 includes a light emitting element (LED) and a photodetecting element (PD) for receiving reflected light, and can judge presence/absence of a sheet based on a detection value of the reflected light. In other words, the post-transfer jam sensor 11 can sense a paper jam in a transfer operation by detecting whether a sheet being forwarded on the transfer drum 5 has reached a position confronting the sensor 11 in a predetermined time.

Figure 5A:
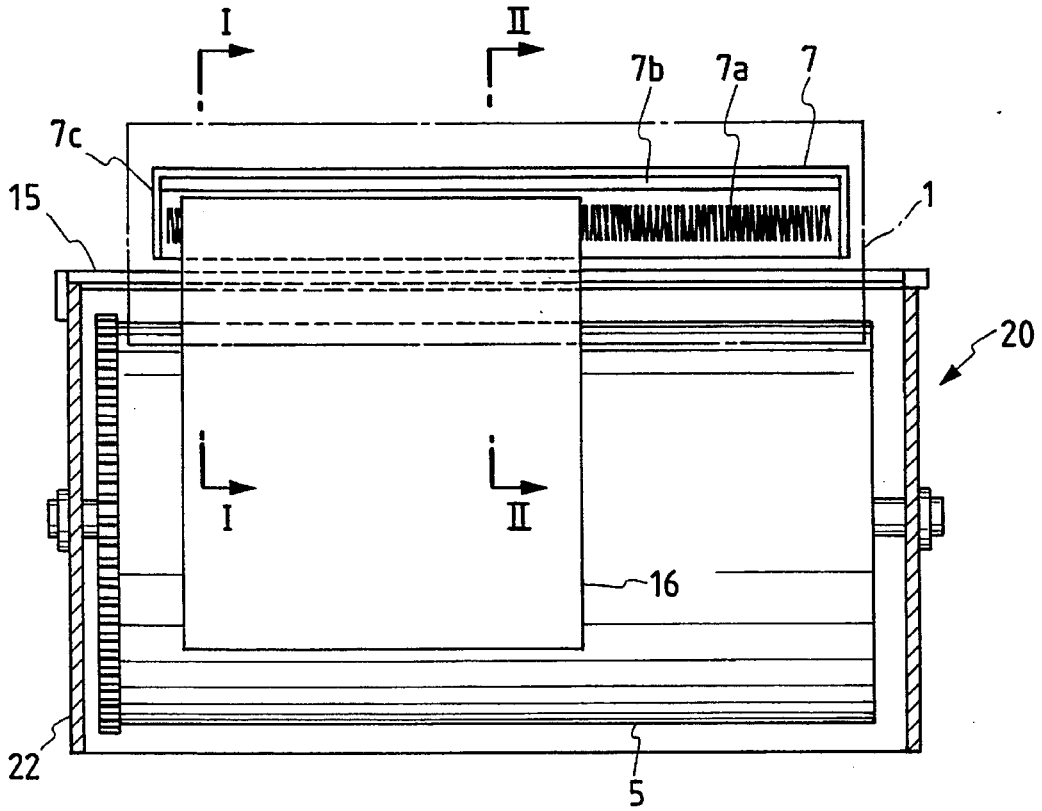
FIGS. 5A–5C, 6A–6C, and 7A–7C show conditions of a sheet when the transfer drum is pulled out
Figure 5B:
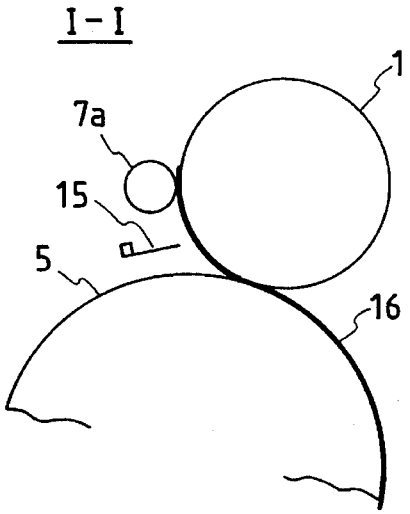
Figure 5C:
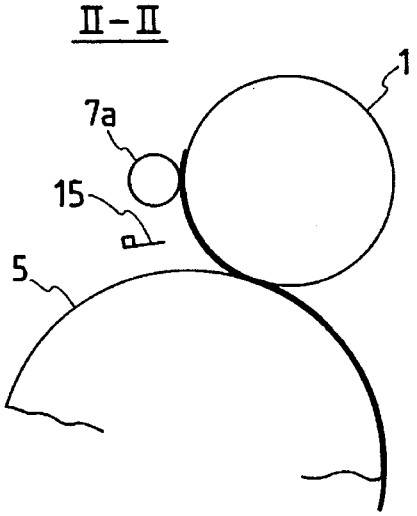

The cleaning device 7 has a cleaning brush 7*a* and a cleaning blade 7*b*. The cleaning brush 7*a* is so disposed as to confront the image carrying body 1, and the cleaning blade 7*b* is disposed downstream of the cleaning brush 7*a* in the image carrying body 1 rotating direction. The cleaning brush 7*a* and the cleaning blade 7*b* are supported so as to come in contact with the image carrying body 1 at an appropriate pressure. Further, as shown in FIG. 5A, side seals 7*c* for preventing leakage of toner are arranged on both sides of the cleaning device 7.

In the thus-constructed image forming apparatus, the image carrying body 1 is electrically charged uniformly by the charging device 2, and a yellow latent image is formed at a predetermined position on the image carrying body 1 by a laser beam emitted from the exposing device 3. Then, the developing unit 4 starts rotating to move the yellow developing device 24Y to the position confronting the image carrying body 1, and a predetermined bias voltage is applied to the developing device 24Y. As a result, electrically charged toner is selectively transferred onto the image carrying body 1 to thereby develop the latent image. More specifically, the toner that has been electrically charged with the same polarity as the surface of the image carrying body 1 which has been electrically charged by the charging device 2 is then deposited on the portion of the image carrying body 1 which has been irradiated with a laser beam. Thus, a toner image is formed. In the meantime, a sheet is forwarded along the paper guide 19. When the sheet passes through the position at which the adsorbing corotron 12 confronts the paper forward roller 13, a discharge occurs, so that the sheet comes to be adsorbed electrostatically to the circumferential surface of the transfer drum 5. The toner image on the image carrying body 1 is carried to the position confronting the transfer drum 5 and brought into contact with the sheet that is adsorbed to the circumferential surface of the transfer drum 5, so that the toner image is transferred onto the sheet by the action of the transfer charger 10. The toner remaining on the image carrying body 1 is adjusted by the pre-cleaning corotron 6 so as to have an appropriate amount of charge, and thereafter removed by the cleaning device 7.

Then, as the second cycle, the image carrying body 1 is electrically charged again by the charging device 2, and a laser beam corresponding to a magenta image is applied to a predetermined position on the image carrying body 1 from the exposing device 3. In the meantime, the developing unit 4 starts rotating to move the magenta developing device 24M to the position confronting the image carrying body 1, and a bias voltage is applied to the developing device 24M. As a result, magenta toner moves to the portion of the image carrying body 1 which has been irradiated with a laser beam. Thus, a toner image is developed. The developed toner image is then transferred, i.e., superimposed upon the yellow image on the sheet that is carried by the transfer drum 5.

After similarly going through the third cycle for a cyan image and the fourth cycle for a black image, the toner images for yellow, magenta, cyan, and black are superimposed one upon another on the sheet carried by the transfer drum 5 to thereby form a multicolor toner image. After the sheet has been separated from the transfer drum 5 by the separating device 14, the toner image is fused while being heated and pressed by a fusing device 21 to thereby produce a single sheet of copy image. Further, superfluous charge on the surface of the transfer drum 5 is removed by the charge eliminating device 17, and its surface cleaned by the cleaner 18. The transfer drum 5 is thereafter rotated to the sheet adsorbing position again.

Figure 3:
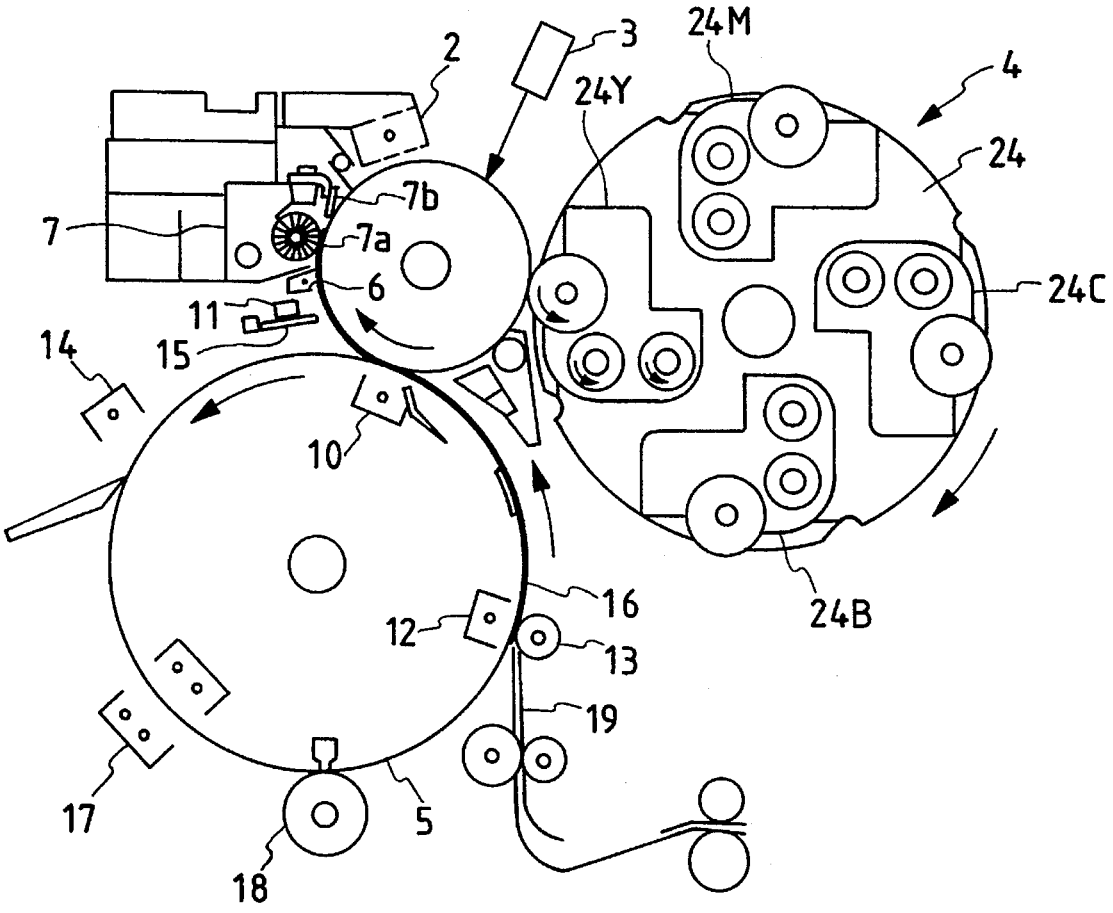
FIG. 3 shows how a sheet jams in the image forming apparatus of FIGS. 1A and 1B.

FIG. 3 shows a paper jam (POP jam, or "paper on the photoreceptor jam") that occurs during the transfer process of the aforementioned image forming process.

A sheet is usually electrostatically adsorbed to the transfer drum 5 firmly during the transfer process. However, if the adsorbing force is reduced for some reason such as distortion of the transfer drum surface or reduction in the water content of the sheet, the sheet attracting force of the electrostatic charge on the image carrying body 1 may become stronger than the sheet adsorbing force of the transfer drum 5. As a result, the sheet 16 comes off the transfer drum 5 to be adsorbed to the surface of the image carrying body 1 as shown in FIG. 3, which in turn causes a paper jam as the image carrying body 1 rotates. When the paper jam is sensed by the post-transfer jam sensor 11 at this instance, the sensor 11 produces a signal to stop the driving of the apparatus. The sheet 16 is forwarded by the rotation of the image carrying body 1 until the apparatus is stopped. The sheet 16 is stopped when its head end reaches the position confronting the cleaning device 7.

FIG. 4 shows a state that the transmission of a driving force to the transfer drum 5 is released at the time of a paper jam. FIGS. 5A–5C to 7A–7C show states of a sheet when the transfer drum 5 is pulled out.

To remove a jammed sheet, the transfer drum 5 is first caused to escape from the image carrying body 1 as shown in FIG. 4. As a result of this operation, the gears 1*a* and 5*a* that transmits the image carrying body 1 driving force are disengaged from each other, thus making the transfer drum 5 freely rotatable in the normal rotational direction. Further, the sheet folding member 15 moves together with the escaping transfer drum 5. At this instance, as shown in FIG. 5A, the head portion of the sheet 16 is interposed between the cleaning brush 7*a* and the image carrying body 1 and its tail portion is adsorbed to the surface of the transfer drum 5.

Figure 6A:
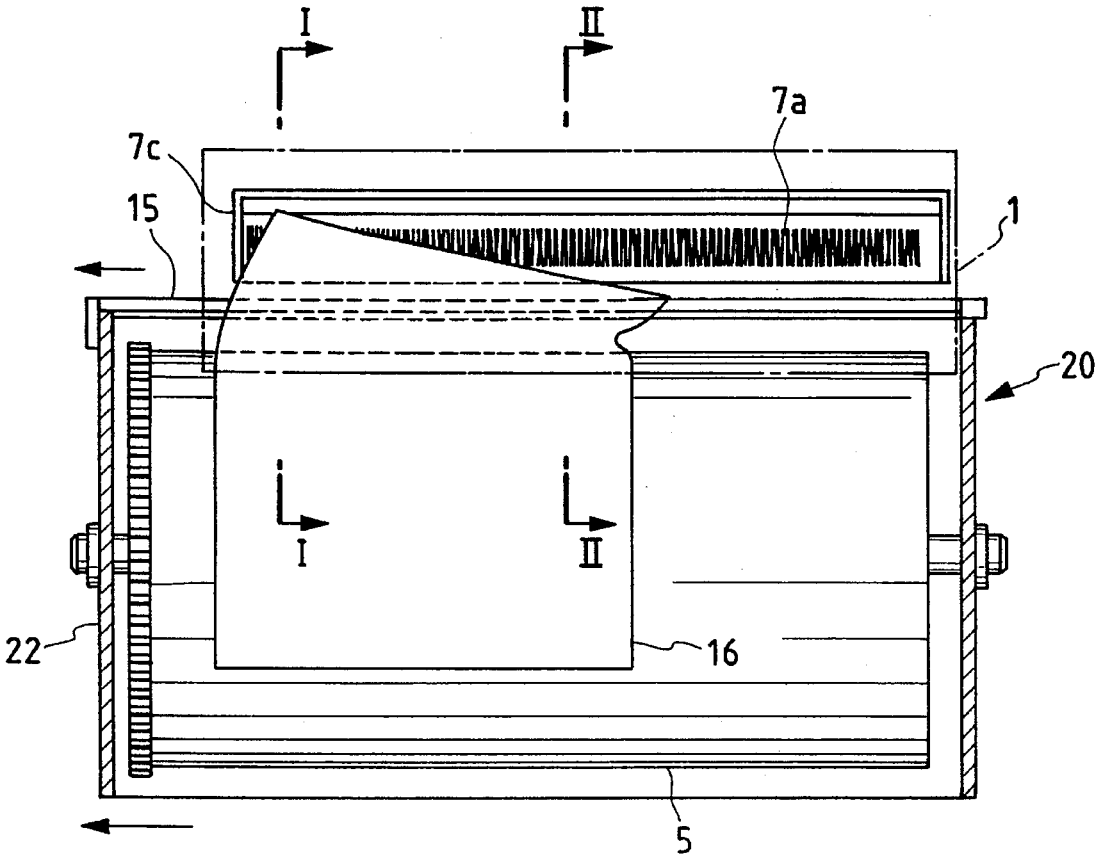
Figure 6B:
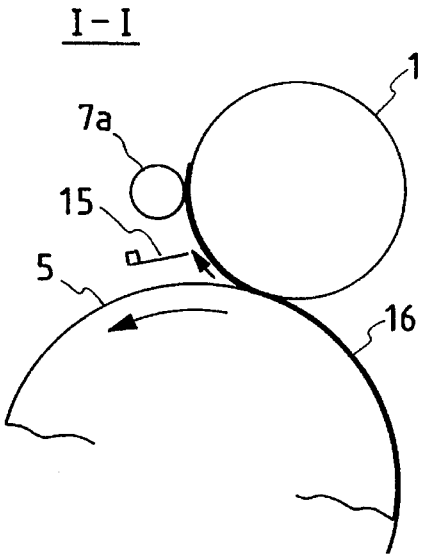
Figure 6C:
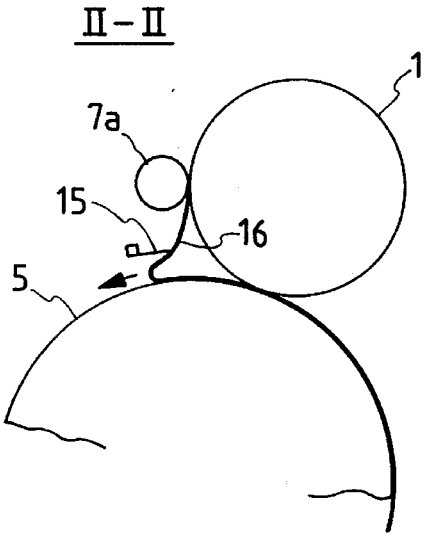

As the transfer drum unit 20 is gradually pulled, as shown in FIG. 6, to remove the jammed sheet, the sheet 16 is dragged until its head portion comes into contact with the side seal 7*c* of the cleaning device 7, because its tail portion is electrostatically adsorbed to the transfer drum 5. Under this condition, the following three forces are applied to the sheet 16:

(1) a force by which the transfer drum 5 pulls the sheet 16 outside;

(2) A force by which the side seal 7*c* pushes back the sheet 16 inside; and (3) A force by which the cleaning brush 7*a* and the image carrying body 1 clamps the head portion of the sheet 16 therebetween.

As a result of the above three forces, a rotating force is given to the head portion of the sheet 16 with a portion of the sheet 16 contacting with the side seal 7*c* serving as a pivot. At this instance, the pulling side of the sheet 16 is pulled in such a direction as to be separated from the transfer drum 5 as the transfer drum unit 20 moves (see FIG. 6B), which in turn rotates the transfer drum 5 through the adsorbing force of the transfer drum 5. The rotation of the transfer drum 5 causes the tail portion of the sheet 16 to be curved, and this causes the sheet 16 on the opposite side (the side opposite to the pulling side) to come in contact with the edge of the paper folding member 15 that is disposed downstream of the transfer drum 5 (see FIG. 6C).

Figure 7A:
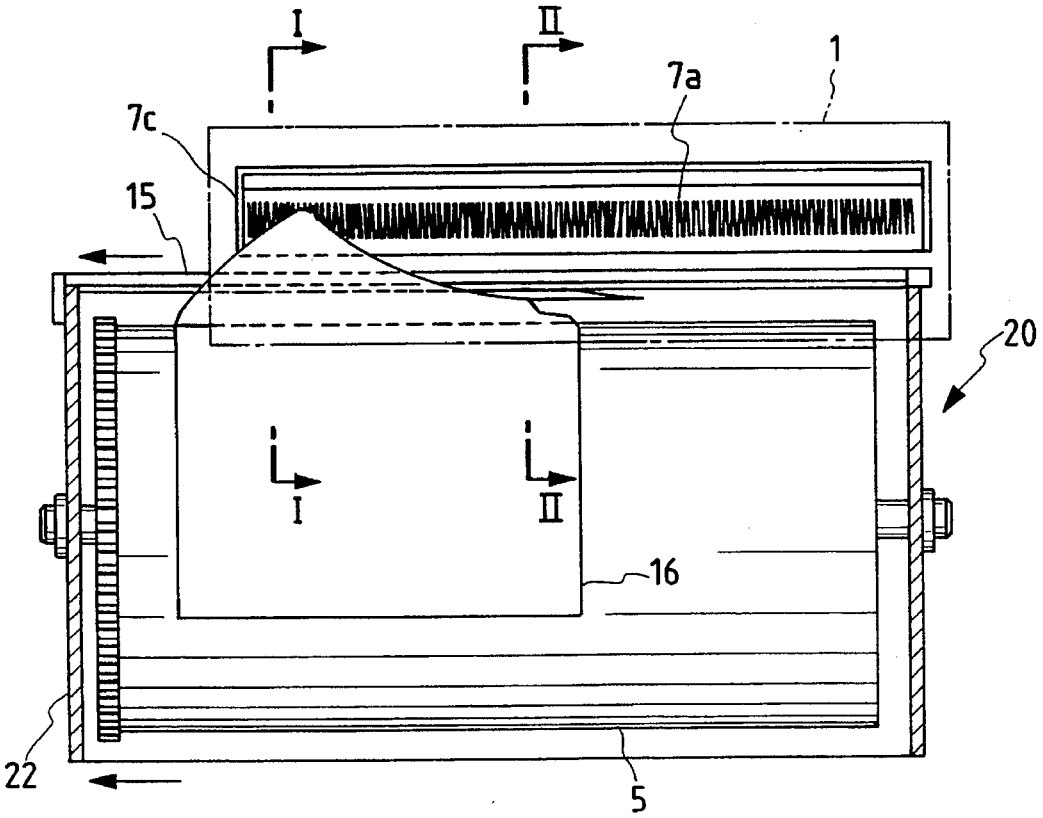
Figure 7B:
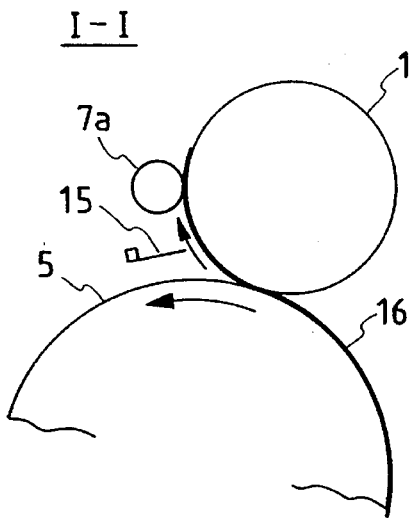
Figure 7C:
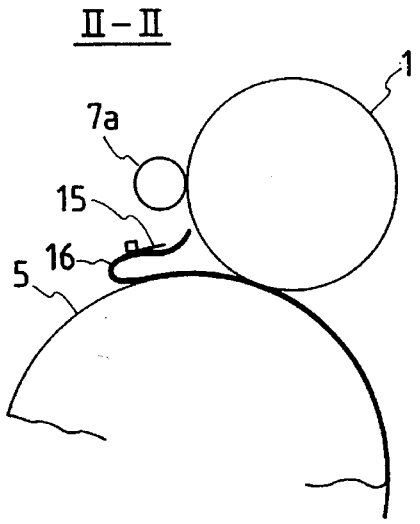

When the transfer drum unit 20 is further pulled as shown in FIG. 7A, the curved portion of the sheet on the opposite side is folded below the paper folding member 15 by the rotation of the transfer drum 5. As a result, a force for biasing the sheet 16 onto the transfer drum 5 is applied to thereby allow the sheet 16 to be taken out without getting separated from the transfer drum 5. Further, the portion of the sheet 16 on the opposite side above paper folding member 15 is taken out of the position at which the sheet 16 contacts the cleaning brush 7*a* and image carrying body 1 by the force of the rotating the head portion of the sheet 16 still in contact with the transfer drum 5 and is folded between the paper folding member 15 and the transfer drum 5. This action gradually proceeds toward the pulling side. In this manner, the portions of the sheet 16 that has threaded into the cleaning device 7 can be removed without being torn. By pulling the transfer drum 5 further, the thus-folded sheet 16 can be taken out while being held between the paper folding member 15 and the transfer drum 5. Hence, the sheet 16 can be taken out of the apparatus.

An experiment was conducted on an apparatus that does not have a paper folding member 15 for purposes of comparison. That is, the transfer drum was pulled in a similar POP jam condition. It has been verified that the sheet 16 cannot be removed from the cleaning brush 7*a*, but gets separated first from the transfer drum 5 pulling side and torn, leaving a piece of the sheet inside the cleaning device 7. Therefore, the image forming apparatus, which is the embodiment of the invention, allows a jammed sheet to be taken out of the apparatus while being folded between the paper folding member 15 and the transfer drum 5, thus preventing the parts inside the apparatus from being damaged due to the tearing of a sheet.

Further, since a paper jam is sensed by the jam sensor 11 located at the position confronting the transfer drum 5, it is no longer necessary to locate a jam sensor at the position confronting the photoreceptor as in the conventional image forming apparatus. As a result, even if a hard-to-sense image such as a yellow image is formed on a sheet, the sensing of the sheet at the position confronting the transfer drum 5 prevents erroneous sensing of a jammed sheet.

Figure 8:
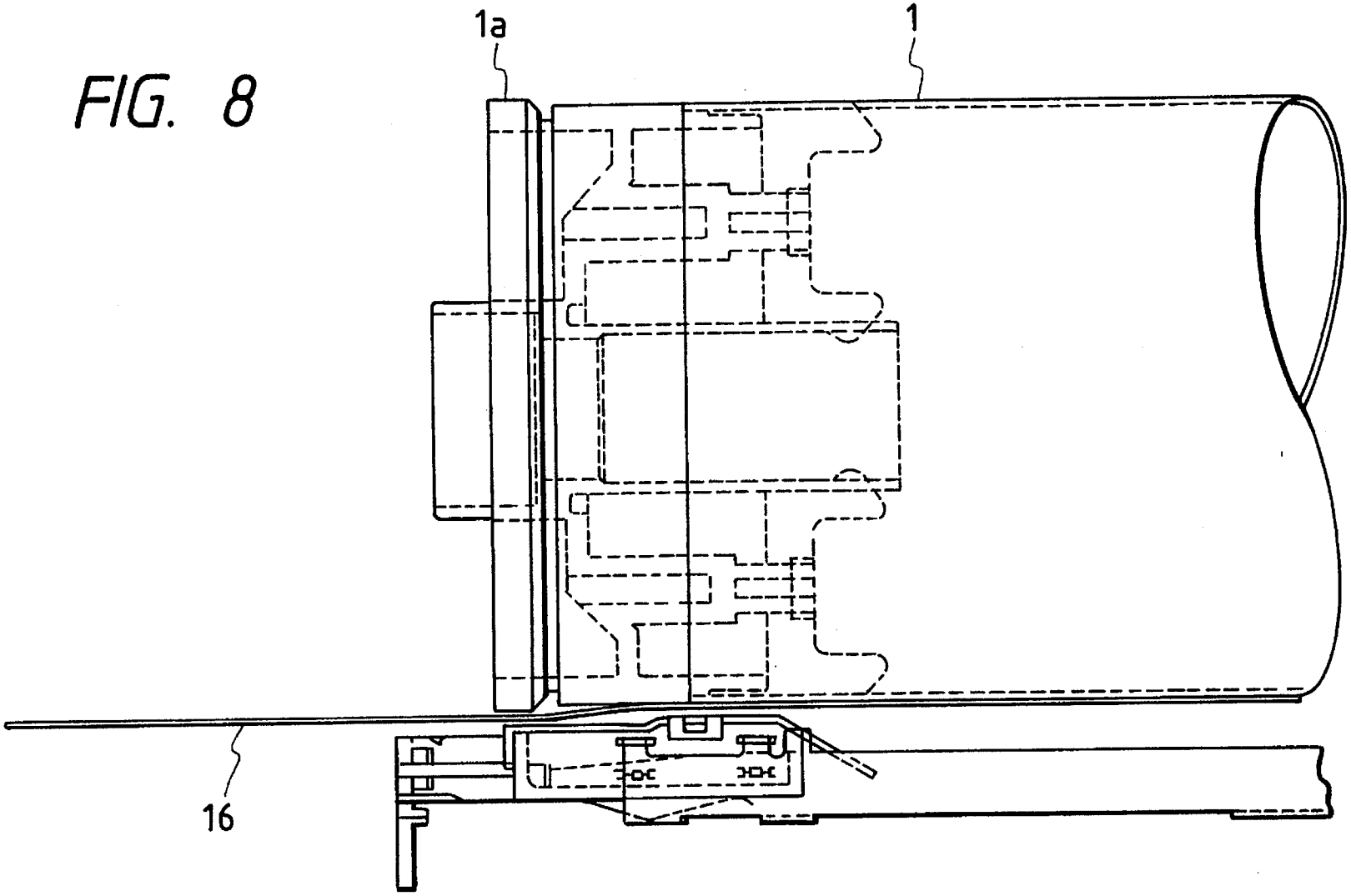
FIG. 8 shows the shape of a gear mounted on an image carrying body used in the image forming apparatus of FIGS. 1A and 1B.

Further, in the image forming apparatus of the invention, as shown in FIG. 8, the inner edge of the gear 1*a* , which is provided at an axial end of the image carrying body 1, is tapered to eliminate an angled portion. If the inner edge of the gear 1*a* were left right-angled as in the conventional example, a sheet being taken out together with the transfer drum 5 as the transfer drum 5 pulled out would be torn when hits the angled portion of the gear. However, the tapering of the gear 1*a* as described above allows a sheet hitting the gear 1*a* to be guided to the pulling side. Thus, the sheet is prevented from being torn.

Figure 9A:
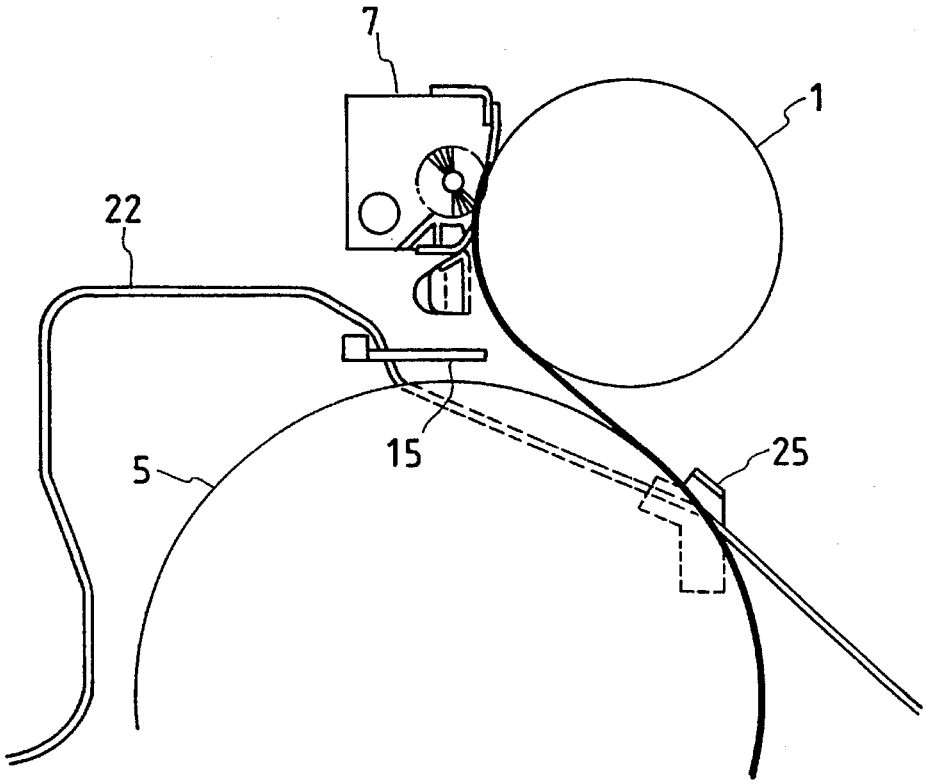
FIGS. 9A and 9B show a projection used in the image forming apparatus of FIGS. 1A and 1B and a function of the projection.

Still further, in the aforementioned image forming apparatus, as shown in FIG. 9, an angled projection 25 can be formed at an end of the transfer drum 5 on the opposite side, in which the projection 25 projects substantially perpendicularly to the circumferential surface of the transfer drum. The projection 25 is firmly supported by the frame 22 of the transfer drum unit 20, and is located slightly upstream of the position confronting the image carrying body 1 in the transfer drum 5 moving direction. If the projection 25 is located too close to the head end of a sheet, then the sheet will be torn and left in the apparatus. Conversely, if it is located too remote, then a sheet once picked up by the projection 25 will escape therefrom. Therefore, the projection 25 must be located at an appropriate position.

Figure 9B:
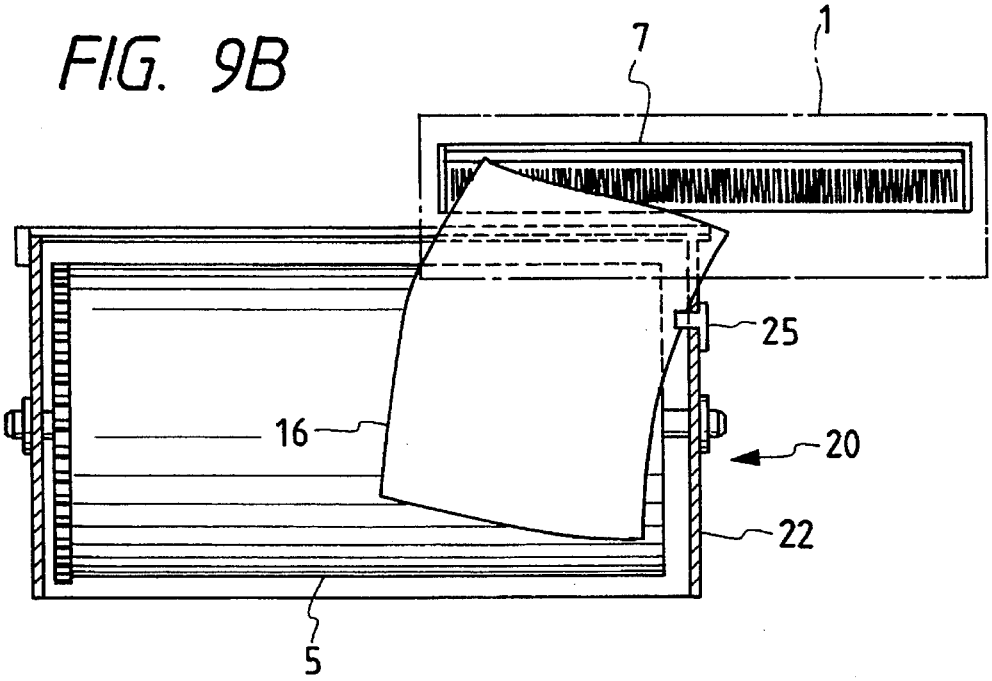

FIG. 9B shows how the projection 25 operates when the transfer drum 5 is pulled out. When a paper jam occurs, a jammed sheet 16 is supposed to be taken out while being interposed between the paper folding member 15 and the transfer drum 5 as described above. However, a jammed sheet may, in some cases, fail to be folded under the paper folding member 15 depending on the stopping position of the sheet. In this case, even if the sheet gets separated from the transfer drum 5 as the transfer drum unit 20 is pulled, the sheet 16 is picked up by the projection 25 as shown in FIG. 9B, which thus allows the sheet 16 to be taken out of the apparatus together with the transfer drum 5. Therefore, even if the paper folding member 15 fails to take the sheet 16 thereunder, the image forming apparatus of the invention can prevent the sheet 16 from being torn and remaining inside the apparatus, which hence contributes to improving the sheet removing performance in the event of a paper jam.

Figure 10:
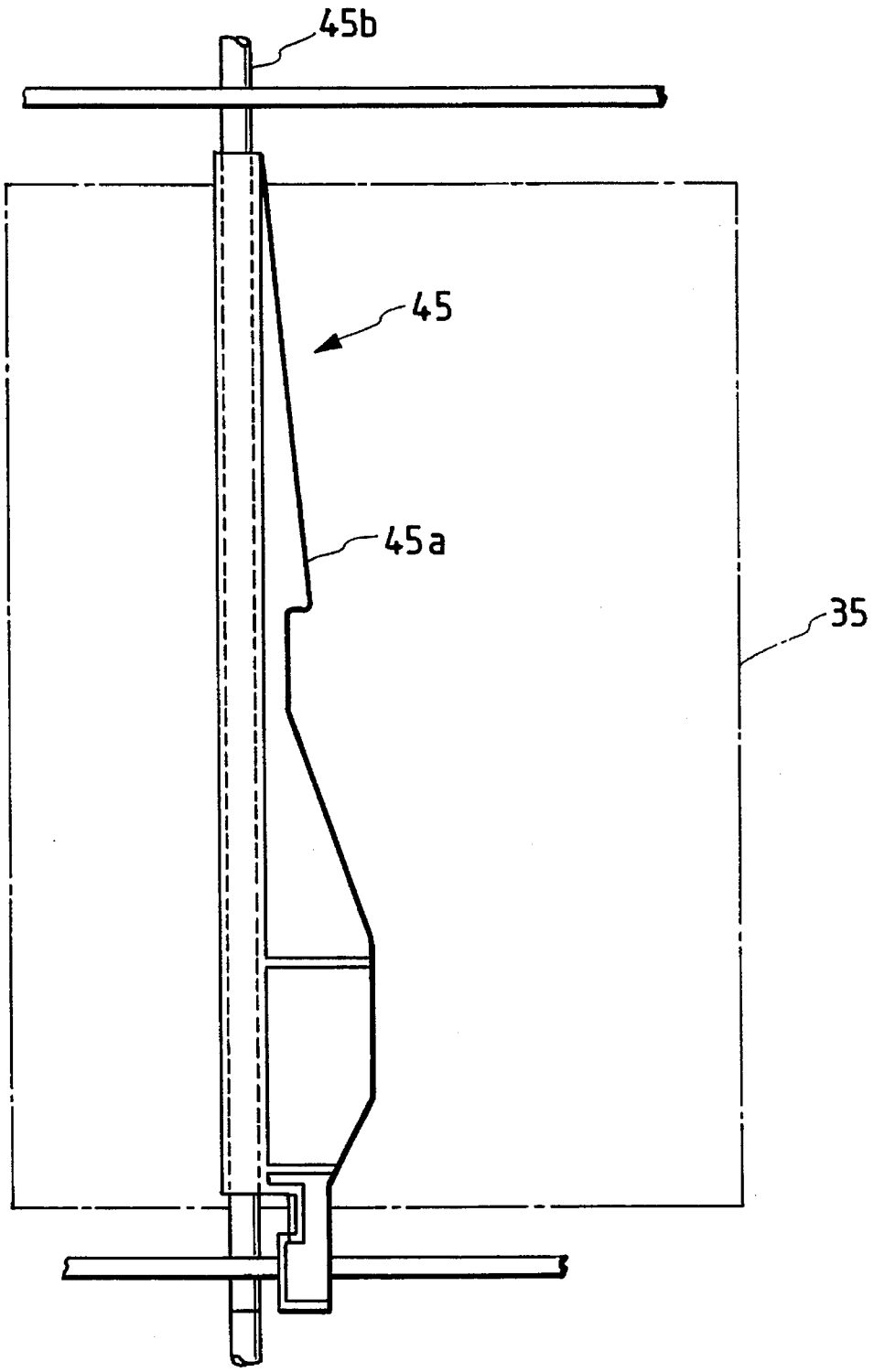
FIG. 10 shows a paper folding member according to another embodiment of the invention.

FIG. 10 schematically shows the construction of a paper folding member 45 used in an image forming apparatus, which is another embodiment of the invention.

The paper folding member 45 has an edge that projects more to the upstream side in the transfer drum 35 rotating direction at a position closer to the transfer drum pulling direction (i.e., toward the bottom end as viewed in FIG. 10). A notch is formed in the edge portion at a position corresponding to a density control sensor (ADC sensor; not shown). A portion of the edge in the vicinity of the notch is made smoothly continuous to the portion of the edge which projects upstream. The paper folding member 45 includes a support shaft 45*b* and a platelike member 45*a* supported by the support shaft 45*b* in a manner similar to the aforementioned embodiment. That is, the surface of the platelike member 45*a* is supported substantially in parallel with the axis of the transfer drum 35.

It is noted that the image forming apparatus having the paper folding member 45 is configured in the same manner as the image forming apparatus shown in FIGS. 1A and 1B, although not shown in the drawings.

If the thus-constructed paper folding member 45 is employed, interference of the paper folding member 45 with, e.g., the ADC sensor that is located at such a position as to overlap with the paper folding member 45 can be avoided. It may be noted that the ADC sensor is not taken out together with the transfer drum 5 when the latter is pulled, but is fixed to a frame that supports the image carrying body 1.

Further, since the portion of the edge in the vicinity of the notch is made smoothly continuous to the portion of the edge which projects upstream, this design prevents a sheet from being caught in the notch and remaining inside the apparatus when the transfer drum 45 is pulled out, which hence allows the sheet to be taken out of the apparatus without being torn, as in the case with the aforementioned embodiment.

As described in the foregoing, the image forming apparatus of the invention is characterized as not only allowing a sheet to be removed from the cleaning device but also allowing the sheet to be folded between the paper folding member and the transfer drum as the transfer drum is pulled out. That is, the sheet can be removed from the position at which the sheet contacts with the cleaning brush without being separated from the transfer drum. Therefore, it can be prevented that the sheet is torn in the vicinity of the cleaning device and a torn piece remains inside the apparatus. As a result, a POP jam sheet can be taken out of the apparatus easily and quickly, and there can be avoided such inconvenience as damaging of the apparatus due to a torn piece of paper remaining inside the apparatus.

What is claimed is:

1. An image forming apparatus comprising:

an image carrying body having a circumferential surface on which a latent electrostatic image is to be formed;

a developing device for forming a toner image by depositing toner on the latent electrostatic image;

a transfer drum rotatably supported in proximity to or in contact with the image carrying body, the transfer drum being a cylindrical member holding, on a circumferential surface thereof, a recording sheet on which the toner image is to be transferred, the transfer drum being supported so that it can be pulled out along an axis thereof when the recording sheet is jammed;

drive means for rotationally driving the transfer drum at the time of transferring the toner image;

a cleaning member being in contact with the image carrying body, for eliminating toner remaining on the image carrying body after completion of a transfer operation;

a platelike paper folding member disposed downstream of a position at which the transfer drum confronts the image carrying body, and having a surface that confronts the circumferential surface of the transfer drum substantially in parallel with the axis of the transfer drum, and an edge that projects more to an upstream side at a position of the edge closer to a transfer drum pulling side; and driving force transmission release means for releasing transmission of a driving force from the drive means to the transfer drum, and for rendering the transfer drum freely rotatable at least in a normal rotational direction thereof when the transfer drum is pulled out.

2. The image forming apparatus according to claim 1, wherein the paper folding member is formed with a notch in an edge portion thereof projecting to the upstream side, and a portion of the notch on the transfer drum pulling side is so shaped as to project more at a position of an edge of the notch closer to the transfer drum pulling side.

3. The image forming apparatus according to claim 1, further comprising:

a gear secured to an end portion of the image carrying body on the transfer drum pulling side, for transmitting a driving force to the image carrying body, the gear having a larger outer diameter than the circumferential surface of the image carrying body; and a sloped surface formed between an inner circumferential edge of the gear and the circumferential surface of the image carrying body, for guiding the recording sheet when it is pulled out together with the transfer drum.

4. The image forming apparatus according to claim 1, further comprising a release preventing member attached to a frame for supporting the transfer drum at a position on a side opposite to the transfer frame pulling side and upstream of the position at which the transfer drum confronts the image carrying body so as to project outward past a height of the peripheral surface of the transfer drum, whereby the release preventing member allows a jammed recording sheet to be pulled out by hooking it when the transfer drum is pulled out.

* * * * *